US006203282B1

(12) United States Patent
Morin

(10) Patent No.: US 6,203,282 B1
(45) **Date of Patent: *Mar. 20, 2001**

(54) METHOD TO CONTROL OUT PUMPING FROM A SEWAGE PUMP STATION

(75) Inventor: Anders Morin, Nacka (SE)

(73) Assignee: ITT Flygt AB, Solna (SE)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/729,087

(22) Filed: Oct. 10, 1996

(30) Foreign Application Priority Data

Nov. 24, 1995 (SE) ..... 9504197

(51) Int. Cl.[7] ..... F04B 49/06
(52) U.S. Cl. ..... 417/44.1; 417/423.3; 417/53
(58) Field of Search ..... 417/44.1, 423.3

(56) References Cited

U.S. PATENT DOCUMENTS 2,687,693 * 8/1954 Hudson ..... 417/44.1
2,787,960 * 4/1957 Wightman ..... 417/44.1
3,953,777 * 4/1976 McKee ..... 318/474
4,049,013 * 9/1977 Shenk ..... 137/263
4,065,227 * 12/1977 Rose ..... 417/45
5,181,841 * 1/1993 Kirkland ..... 417/423.3
5,549,456 * 8/1996 Burrill et al. ..... 417/12
5,667,362 * 9/1997 Murai et al. ..... 417/44.1
5,833,437 * 11/1998 Kurth et al. ..... 417/423.3

OTHER PUBLICATIONS

"Pump Handbook", Karassik, I et al, McGraw Hill p. 10.34.*

* cited by examiner

*Primary Examiner*—Timothy S. Thorpe
*Assistant Examiner*—Cheryl J. Tyler
(74) *Attorney, Agent, or Firm*—Menotti J. Lombardi

(57) ABSTRACT

A method to control stops of an intermittently operating electric motor that drives a submersible pump arranged in a pump station for sewage water, wherein starts and stops of the motor depend on the water level in the pump station or on any other electric parameter possible to measure, and where a stop of the motor is initiated when the water level has gone down to the upper part of the motor. The method involves the steps of selecting intervals for pumping down to a level below that of the upper part of the motor where the pump starts sucking air, and pumping down to the lower level at each of the selected intervals until the pump starts sucking air.

14 Claims, 2 Drawing Sheets

METHOD TO CONTROL OUT PUMPING FROM A SEWAGE PUMP STATION

FIELD OF THE INVENTION

The invention concerns a method to control starts and stops of a pump or pumps in a sewage pump station the pumps being of the submersible type.

BACKGROUND OF THE INVENTION

A pump of this type comprises a tank having an inlet for sewage water and one or several electrically driven pumps arranged in the lower part of the tank. The pump/pumps are connected to a pressure pipe which brings the pumped water away.

When using pumps it is of course important to avoid dry operation as much as possible as this increases wear and energy demand. It is also an advantage to let the surrounding water cool the electric motor which means that the pumps are normally stopped when the water level has reached the upper part of the pump.

The impulses to start and stop the pump/pumps may be obtained by help of level switches which are arranged at different levels in the tank or by means which monitor the current consumption. There are different systems for this which include possibilities to alternate the pumps in a tank containing at least two pumps and also to initiate an earlier or later start if the previous operation cycle has been long or short caused by a large or a small inflow to the tank. Compare the Swedish Patents No:s 469 408 and 420 788.

A disadvantage with an automatic stop of the pump when the water level has reached the upper part of the pump is that sludge and other pollutions easily collect within the lower volume of the tank which is never emptied. These pollutions easily stick to the pump impellers and might mean very frequent service intervals. The present development towards narrow pump stations increases the problems. A common way to solve an acute situation is to operate the pumps backwards by disconnecting the automatic control.

SUMMARY OF THE INVENTION

A method to control stops of an intermittently operating electric motor that drives a submersible pump arranged in a pump station for sewage water, wherein starts and stops of the motor depend on the water level in the pump station or on any other electric parameter possible to measure, and where a stop of the motor is initiated when the water level has gone down to the upper part of the motor. The method comprises the steps of selecting intervals for pumping down to a level below that of the upper part of the motor where the pump starts sucking air, and pumping down to the lower level at each of the selected intervals until the pump starts sucking air.

DETAILED DESCRIPTION OF THE INVENTION

Figure 1:
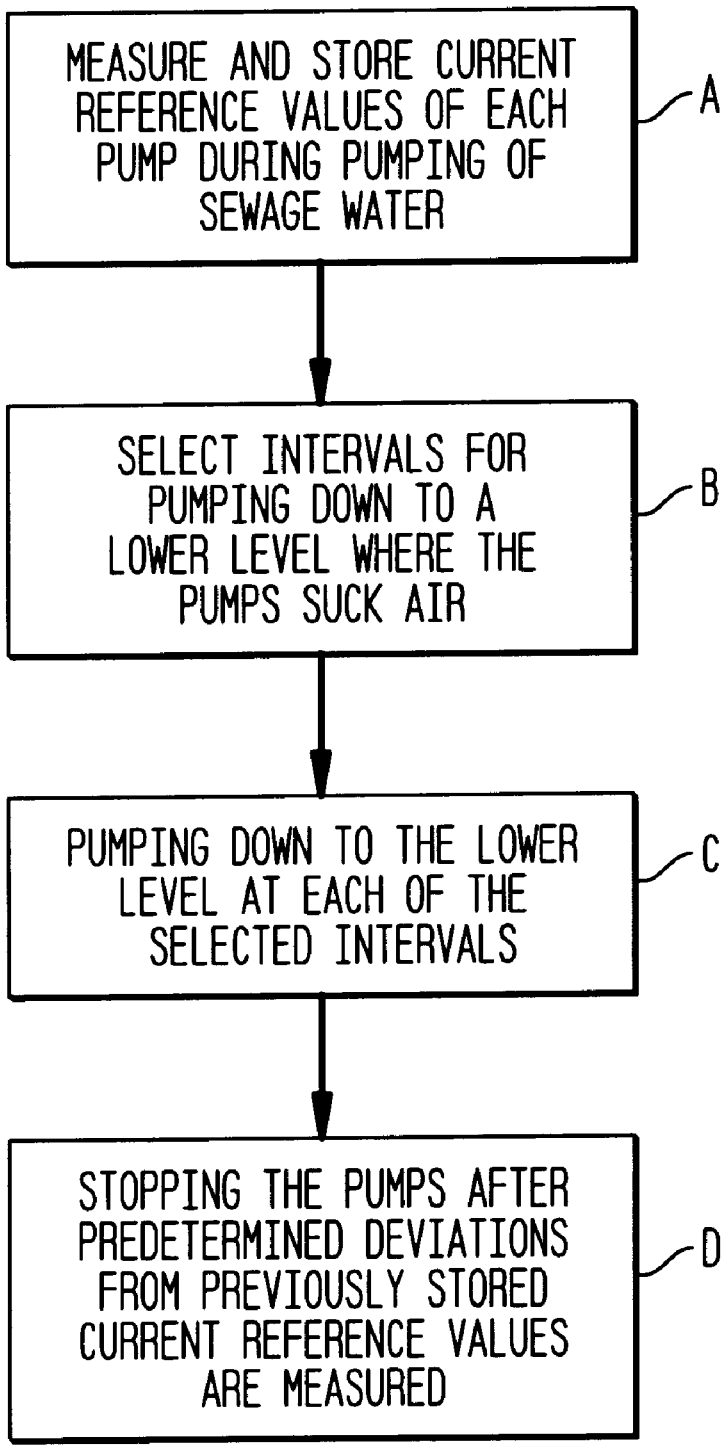
FIG. 1 is a flowchart of the method of the invention.

According to the invention the problem to diminish the risks for collection of pollutions that may cause stops in operation is solved by help of the method of the invention depicted by the flowchart shown in FIG. 1. The system, called APF and mainly used for two pumps, is connected in parallel with the ordinary system and so designed that one pump operates if any of the systems indicate operation.

The ordinary system normally controls start and stop of the pumps. The APF system then measures the current via a current transformer and registers the normal current consumption. By this reference values are obtained and stored for each pump as depicted in step A.

At certain times, for instance once or some times per day as depicted in step B, APF is programmed to take over the control from the ordinary system. The operation of a pump then continues until the water level has reached the pump inlet causing the pump to suck air as depicted in step C and. The current consumption then goes down and after a certain deviation from previously stored reference values, the pump is stopped as depicted in step D. Compare the Swedish Patent No. 469 408.

In this way the water amount remaining within the tank is minimized and thus the amount of remaining pollutions is also minimized. In addition deposits and layers on the walls and on the pumps will be broken down and may more easily be pumped away.

Referring again to step B of the method, the question of how often the pumping shall continue down to the lower level mentioned, is depending on local conditions, i.e. mainly on the amount of pollutions in the water. Under certain circumstances the operation should be carried out once per hour. Sometimes once per day may be sufficient. The operation may also be performed after a certain number of normal stops. The equipment used to obtain the function is so designed that various alternatives may be chosen.

Figure 2:
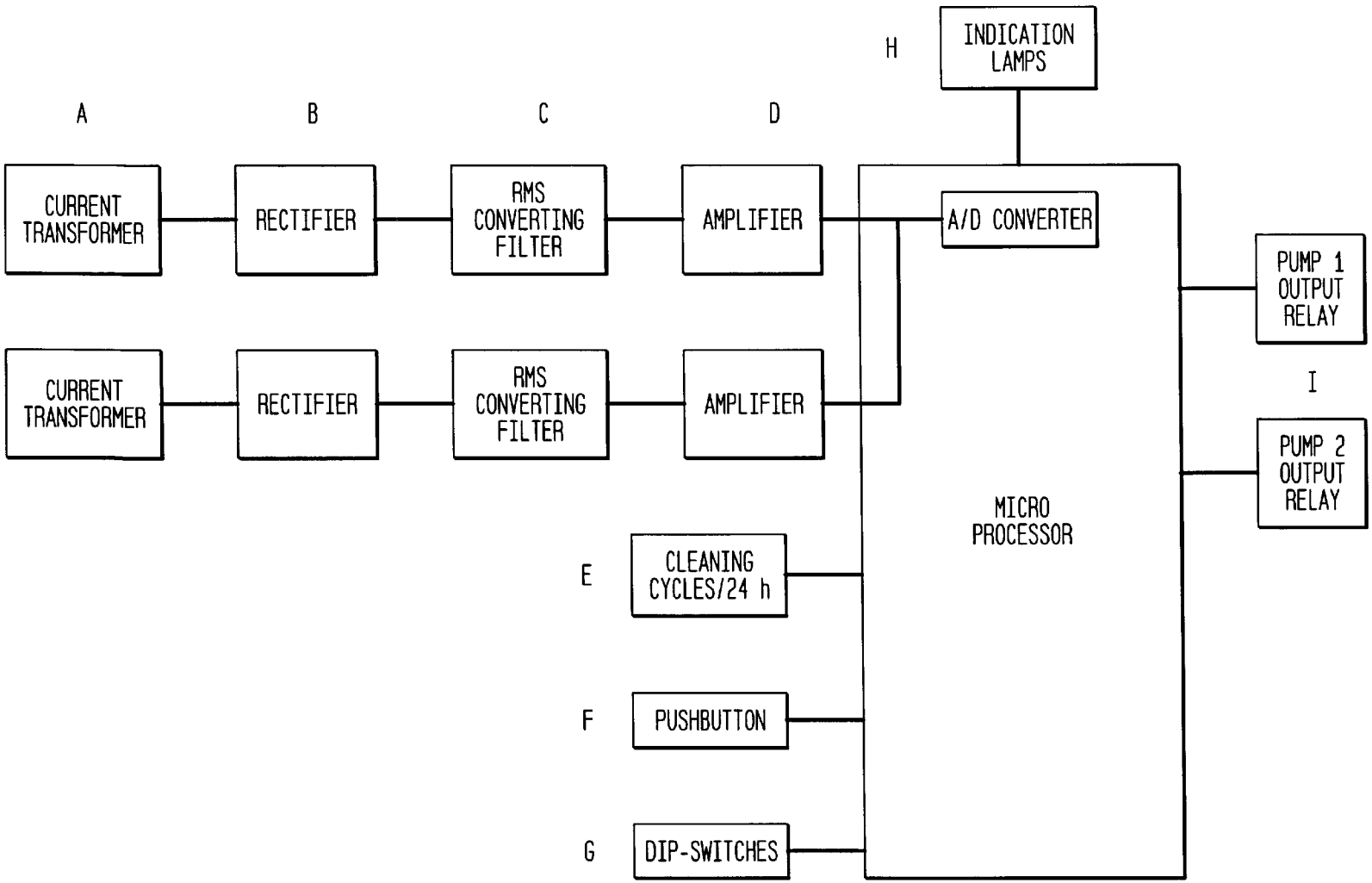
FIG. 2 is a block diagram of a system according to the invention for carrying out the method.

In the FIG. 2 stands for a current transformer, B a rectifier, C a low-pass filter, D an amplifier, E a rotary switch, F a push button, G a switch, H indication lamps and I pumps.

A current signal from a pump is obtained by a current transformer (A) through which one of the conductors of the pump motor is drawn. The input is designed to register the absolute value and the differential coefficient of the motor current.

The signal is rectified in a first step (B) and is then treated in three cascade low-pass filters which form together a certain time constant (0.26 sec as an example). In addition to build the mean value for the signal the filter also serves as an anti folding filter for the following sampling.

A subsequent amplifier (D) amplifies the signal to adopt the level of the processor (5.7 times in the example).

The input voltage is 0–5 V. During normal motor operation the current transformer generates 55 mA which obtain a voltage of 2.5 V into the processor.

A transducer integrated within the processor transforms the measured signal into digital form (10 bits) which makes it possible to treat the signal by software.

The signal treatment shall make it possible to detect changes in the current consumption of a pump motor which is characterizing for a pump which starts sucking air. Two events are defined to lead to a stop:

1. A negative differential coefficient of the amplitude of the current exceeding a certain value.
2. A deviation of a current value from the reference value exeeding a certain percent (6 or 12%).

In order to analyze the current with reference to point 1 above, the signal is filtered through a high-pass filter having a time constant of 0.68 sec. In this way the changes that should lead to a stop are exposed.

The signal treatment according to point 2 means that the absolute values of the motor current are measured and compared with the stored reference values.

For setting the number of cycles of down pumpings per day a binary coded rotary switch (E) is used. The value is read by the microprocessor which transform the frequency into time between pumping cycles.

When APF is started, a counting down of the determined time to next down pumping is started. When the time has lapsed, a down pumping cycle is started the first time a pump is started alone. When the down pumping is finished, the register is reloaded and a new counting down is started.

The push button (F) is used to start down pumping at next pump start and also to initiate a new reference current value for the stop function.

Four dual-position switches (G) are used to set the parameters. A blank time (during which the stop function is non-active after start) is set to avoid fault functions depending on initial current differences.

(H) in the block diagram symbolizes indications of different functions with diodes for feeding voltage, pump relay 1, pump relay 2, current input 1, current input 2 and "down pumping phase at next pump operation".

The system described above is an example of how the control can be made. However, the invention is universal and not depending on which type of level security systems that are used in the pump station. The important thing is that the pumping continuous to a lower level automatically according to a certain scheme.

What is claimed is:

1. A method to control stops of an intermittently operating electric motor that drives a submersible pump arranged in a pump station, the pump being operative for pumping sewage water, starts and stops of the motor being dependent on the sewage water level in the pump station, the method comprising the steps of:

stopping said electric motor at a first level when the sewage water level in the pump station has gone down to an upper part of said pump; and at preselected intervals, pumping below said first level and stopping said electric motor when the sewage water level in the pump station reaches a water inlet of said pump.

2. The method to control stops of an intermittently operating electric motor according to claim 1, wherein the criteria used for controlling the stops is selected from the group consisting of the absolute value of the current, changes in the absolute value of the current and swift variations in the absolute value of the current.

3. The method to control stops of an intermittently operating electric motor according to claim 1, wherein the stops are controlled by changes of the energy consumption of the motor.

4. The method of claim 1, wherein the frequency of the preselected intervals depend upon the amount of pollutions present in said sewage water.

5. The method of claim 4, wherein the frequency of the preselected intervals is further dependent upon a rate at which deposits from said sewage water form.

6. A method for operating an electric motor driven pump which pumps sewage water, said method comprising the steps of:

automatically starting said pump when sewage water is at a predetermined level above said pump;

automatically stopping said pump at a first level when the sewage water has gone down to the level of an upper part thereof and ceases to effectively cool said motor of said pump; and at preselected intervals, pumping below said first level and automatically stopping said pump when the sewage water reaches the level of a water inlet of said pump and said pump ceases to effectively the pump sewage water.

7. The method of claim 6, wherein the step of automatically stopping said pump when the sewage water reaches the level of a water inlet of said pump, includes the step of approximating a power consumption of said pump.

8. The method of claim 7, wherein said step of at preselected intervals, automatically stopping said pump when the sewage water reaches the level of said water inlet of said pump and said pump ceasing to effectively pump sewage water is responsive to said power consumption of said pump.

9. A method for reducing the amount of deposits which form in a tank, the method comprising the steps of:

providing a plurality of electric motor driven pumps for pumping sewage water from said tank;

automatically starting each of said pumps when the sewage water in said tank is at a predetermined level above said pumps;

automatically stopping said pumps at a first level when the sewage water has gone down to the level of an upper part of each of said pumps and ceases to effectively cool said motors of said pumps; and at preselected intervals, pumping below said first level and automatically stopping said pumps when the sewage water reaches the level of a water inlet of each of said pumps and said pumps cease to effectively the pump sewage water.

10. The method of claim 9, wherein the frequency of the preselected intervals depend upon the rate at which sewage deposits form.

11. The method of claim 10, wherein each of said plurality of pumps are started substantially simultaneously.

12. The method of claim 11, wherein each of said plurality of started pumps are not started substantially simultaneously.

13. The method of claim 9, wherein the frequency of the preselected intervals depend upon the rate at which sewage deposits form.

14. The method of claim 9, wherein the step of automatically stopping said pumps when the sewage water reaches the level of a water inlet of each of said pumps, includes the step of approximating a power consumption of each of said pumps and stopping of said pumps according to said approximated power consumption of each of said pumps.

* * * * *